US009280962B1

(12) United States Patent
Ilimura et al.

(10) Patent No.: US 9,280,962 B1
(45) Date of Patent: Mar. 8, 2016

(54) SOUND PREVIEW DEVICE AND PROGRAM

(71) Applicant: KAWAI MUSICAL INSTRUMENTS MANUFACTURING CO., LTD., Hamamatsu-shi, Shizuoka (JP)

(72) Inventors: Kohtaro Ilimura, Hamamatsu (JP); Sachie Ilimura, Hamamatsu (JP)

(73) Assignee: KAWAI MUSICAL INSTRUMENTS MANUFACTURING CO., LTD, Hamamatsu-shi (JP)

( * ) Notice: Subject to any disclaimer, the term of this patent is extended or adjusted under 35 U.S.C. 154(b) by 0 days.

(21) Appl. No.: 14/818,956

(22) Filed: Aug. 5, 2015

(30) Foreign Application Priority Data

Aug. 20, 2014 (JP) ..... 2014-167918

(51) Int. Cl.
*G10H 5/02* (2006.01)
*G10H 1/34* (2006.01)

(52) U.S. Cl.
CPC ..... *G10H 1/34* (2013.01)

(58) Field of Classification Search
CPC ..... G10H 1/34
USPC ..... 84/615, 622
See application file for complete search history.

(56) References Cited

U.S. PATENT DOCUMENTS 5,739,454 A * 4/1998 Kunimoto ..... 84/615
6,809,248 B2 * 10/2004 Torimura ..... 84/615
2008/0072742 A1 * 3/2008 Nishida ..... 84/615

FOREIGN PATENT DOCUMENTS

JP 3296518 4/2002

* cited by examiner

*Primary Examiner* — Jeffrey Donels
(74) *Attorney, Agent, or Firm* — Lewis Roca Rothgerber Christie LLP

(57) ABSTRACT

Provided is a sound preview device including, in an electronic musical instrument which includes a keyboard 2 and an operation button 1 to perform tone selection or a sound setting and in which tone selection or a sound setting corresponding to a key is performed in advance by pressing the operation button 1 while pressing one of the keys in the keyboard 2, a changed state recognizing unit 3 that recognizes from a pressed key a changed state of tone selection or a sound setting determined corresponding to the key in advance, a phrase storing unit 4 in which phrases of sounds by which an influence of the changed state is easily known are stored in plural numbers according to the changed state, and a sound emitting unit 5 that emits a phrase corresponding to the changed state.

9 Claims, 4 Drawing Sheets

| | |
|---|---|
| TONE | C4/E4/G4/C5 KEYBOARD, ARPEGGIO |
| REVERB SETTING | C5 KEYBOARD |
| DAMPER RESONANCE | C5/E5/G5/C6 KEYBOARD, ARPEGGIO |
| DAMPER NOISE | C5 KEYBOARD |
| STRING RESONANCE | PRESSING C4 KEYBOARD WHILE PRESSING G4/A4/B4/C5 KEYBOARD, ARPEGGIO |
| KEY ACTION NOISE | C4 KEYBOARD |

SOUND PREVIEW DEVICE AND PROGRAM

CROSS-REFERENCE TO RELATED APPLICATION

This application claims priority to and the benefit of Japanese Patent Application No. 2014-167918, filed in the Japanese Patent Office on Aug. 20, 2014, the entire contents of which are incorporated herein by reference.

TECHNICAL FIELD

The present invention concerns an electronic musical instrument typified by a digital piano, and relates to a sound preview device that, when tone selection or a sound setting is changed in the electronic musical instrument, automatically emits its sample sound and a program that performs a sound preview in the electronic musical instrument.

BACKGROUND

An electronic musical instrument, as disclosed in, for example, Japanese Patent No. 3296518, sends musical sound data generated by operating a keyboard or an operation panel to a sound source provided in an interior of the electronic musical instrument, produces a musical sound signal according to the musical sound data in the sound source, and produces a musical sound by converting it to an audio signal by a speaker. For the musical sound, a variety of tones from acoustic piano sounds to electronic pianos, electronic organs, and the like can be selected, and also, setting a reverb effect (reverb) as if playing in a concert hall or the like and/or setting an acoustic effect for a sound emission is possible. Moreover, the contents of a selected or set tone and reverb effect and/or acoustic effect have been displayed on an operation panel (display panel).

Also, in order to realize a more acoustic piano appearance or for a reduction in cost, some types of digital pianos (electronic musical instruments) are without operation panels (display panels) consisting of liquid crystal displays. When performing tone selection in such an electronic musical instrument, as shown FIG. 7, pressing an operation button (sound select key) 1 while performing a change by a key on a keyboard 2 is mainstream.

That is, pressing the operation button (sound select key) 1 while pressing any key of the keyboard 2 allows changing to a tone or a sound setting (setting of a reverb effect or acoustic effect) assigned in advance to each key. For example, pressing the operation button 1 while pressing a key A0 (tone selection) allows setting to the tone of a concert grand piano 1.

SUMMARY OF INVENTION

When a change in tone selection or sound settings is performed in an electronic musical instrument having the structure described above, because there is no particular means for notifying the change in response to the change, it has been necessary, in order to confirm the change, to actually play the electronic musical instrument by pressing the keyboard.

Particularly in the case without an operation panel (display panel), having performed a change has not been able to be instantaneously confirmed.

The present invention has been made in view of the above-described actual circumstances, and it is an object of the present invention to provide a sound preview device and program that, by emitting a sample sound when tone selection or a sound setting is changed in an electronic musical instrument, enables aurally confirming a change in sound.

The present invention is a sound preview device comprising, in an electronic musical instrument which includes a keyboard and an operation button to perform tone selection or a sound setting and in which tone selection or a sound setting corresponding to a key is performed in advance by pressing the operation button while pressing one of the keys in the keyboard;

a changed state recognizing unit that recognizes from a pressed key a changed state of tone selection or a sound setting determined corresponding to the key in advance;

a phrase storing unit in which phrases of sounds by which an influence of the changed state is easily known are stored in plural numbers according to the changed state; and a sound emitting unit that emits a phrase corresponding to the changed state.

In some embodiments, when a tone or sound setting is changed by the key, a sound phrase is emitted.

In some embodiments, when a tone is changed by the key, a phrase of an Arpeggio consisting of C4, E4, G4, and C5 pitches is emitted.

In some embodiments, when a reverb setting is provided by the key, only a C5 pitch is emitted.

In some embodiments, when a damper resonance setting is provided by the key, a phrase of an Arpeggio consisting of C5, E5, G5, and C6 pitches is emitted.

In some embodiments, when a damper noise setting is provided by the key, only a C5 pitch is emitted.

In some embodiments, when a string resonance setting is provided by the key, a phrase of an Arpeggio consisting of G4, A4, B4, and C5 pitches is emitted with a C4 key pressed.

In some embodiments, when a key action noise setting is provided by the key, only a C4 pitch is emitted.

A sound preview program for performing a tone selection or a sound setting corresponding to a key by pressing the operation button while pressing one of the keys in the keyboard; detecting, from a pressed key, a changed state of tone selection or a sound setting determined corresponding to the key; storing phrases of sounds by which an influence of the changed state is known in plural numbers according to the changed state, in a storage device; and emitting a phrase corresponding to the changed state as a sample sound.

According to the sound preview device and program of the present invention, because a phrase is emitted by a sample sound when tone selection or a sound setting (setting of a reverb effect or acoustic effect) is changed, a change in sound due to the setting change can be aurally confirmed.

Also, because a phrase corresponding to a changed state is emitted, a change in settings can be easily recognized.

DESCRIPTION OF EMBODIMENTS

Hereinafter, a sound preview device according to an embodiment of the present invention will be described with reference to the drawings.

Figure 1:
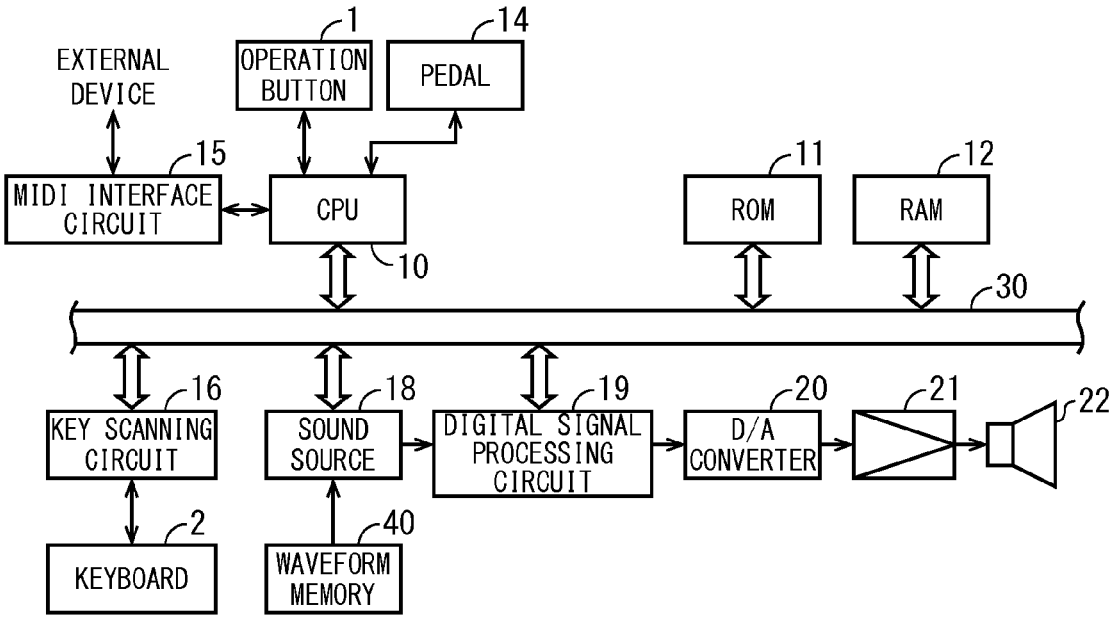
FIG. 1 is a block diagram showing a configuration of an electronic musical instrument in which a sound preview device of the present invention is mounted.

FIG. 1 is a block diagram showing a major hardware configuration of a digital piano (electronic musical instrument) mounted with the sound preview device, and in the configuration, a CPU 10, a ROM 11, a RAM 12, a key scan circuit 16, a sound source 18, and a digital signal processing circuit 19 are connected to a bus 30.

The CPU 10 controls the whole of the digital piano (electronic musical instrument) in accordance with a control program stored in the ROM 11. For example, the CPU 10 performs an assigner processing of assigning a sound emission channel to a key depression, an access processing with respect to the sound source 18, etc.

Also, to the CPU 10, an operation button 1 to be used for tone selection or a sound setting (setting of a reverb effect or acoustic effect), a pedal 14 for imparting a damper pedal effect to a sound emission, and a MIDI interface circuit 15 for performing MIDI data passing control with an external device are connected by dedicated lines.

The operation button 1 connected to the CPU 10 consists of an ON/OFF switch, and brings about an ON-state by sensing being depressed with software. Then, as described in the conventional art, by pressing the operation button 1 while pressing any key of the keyboard 2, various settings such as tone selection are performed.

The keyboard 2 is composed of a plurality of keys with which a player instructs pitches of musical sounds and key switches that open and close in conjunction with the keys. The keyboard 2 is connected to the key scanning circuit 16 that scans a state of the key switch to output the same as key data.

Figure 7:
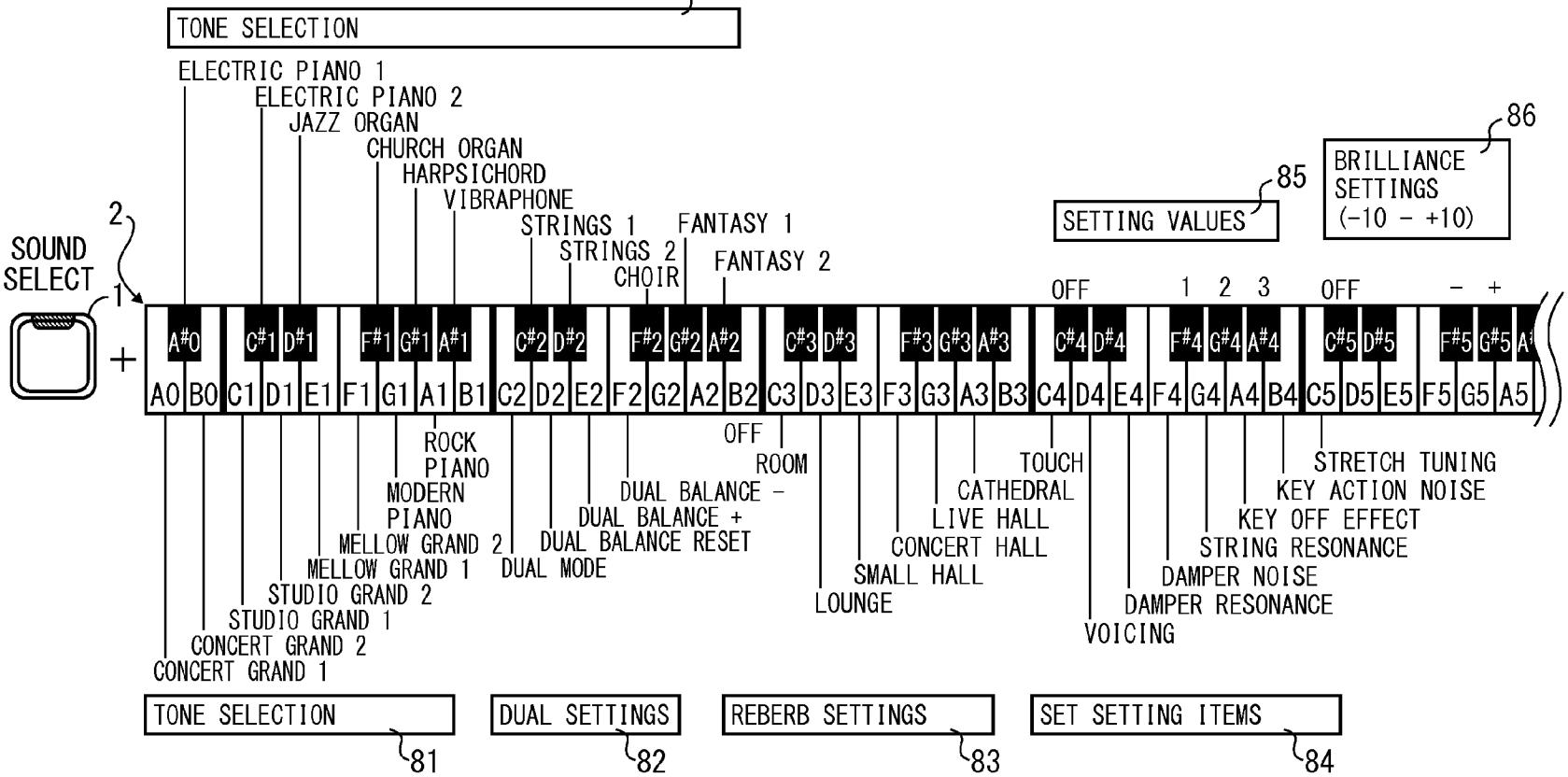
FIG. 7 is a model view showing assignment of a keyboard corresponding to tone selection or sound settings.

To the keys of the keyboard 2, as shown in FIG. 7, keys to perform tone selection 81, keys for dual settings 82 (to be selected when emitting different types of sounds in an overlapping manner), keys for reverb settings 83 (to select a reverb effect), keys to set setting items 84 (to select an acoustic effect by a key depression), keys to specify setting values 85 for an "OFF" setting to the above-mentioned setting item 84 or for setting volume levels "1," "2," and "3" when the item is set, and keys to perform a brilliance setting 86 (to adjust the brilliance of a tone) are made to correspond in advance.

The keys for the tone selection 81 allow selecting a tone to be used for a sound emission from among various tones such as, for example, pianos, organs, and flutes.

The keys for the dual settings 82 allow, besides selecting emitting different types of sounds (for example, a piano and an organ) in an overlapping manner, setting a proportion of the different sounds (which sound is set strong or weak), and resetting the proportion (bringing into a balanced state).

The keys for the reverb settings 83 allow selecting a reverb effect such that the vibrancy of sound (reverberation) in various chambers (such as, for example, a concert hall) can be reproduced.

Selection of an acoustic effect in the setting items 84 enables adjusting, for example, a volume change corresponding to the strength of a key depression, a change in sound due to the hardness of hammer strings and the like, etc. In the setting items 84, by selecting the respective keys corresponding to the setting values 85 ("OFF," "1," "2," and "3") after selecting an item, the volume and the rate of change can be adjusted.

The control keys corresponding to the brilliance setting 86 ("OFF," "–," and "+") allow adjusting the brilliance of a tone.

The pedal 14 connected to the CPU 10 consists of, for example, a foot pedal, and detects a stepping amount (pedal position data) by a detector provided in the pedal to send out the same to the CPU 10. The pedal position data is temporarily stored in the RAM 12, and used for controlling the degree an acoustic effect is displayed.

The ROM 11 stores various programs (for example, a sound preview program), various data, etc., to be executed or referred to by the CPU 10. The programs and data stored in the ROM 11 are referred to by the CPU 10 via the system bus 30. That is, the CPU 10 is structured so as to read out a control program (command) from the ROM 11 via the system bus 30 and interpret and execute the same, and so as to read out predetermined fixed data to use the same for an arithmetic processing.

Also, in the ROM 11, a phrase (sound emission data) that is emitted as a sample sound in a sound preview is saved as sequence data. The phrase (sound emission data) consists of data to emit a sound by which the content of a setting is easily known depending on the type such as a tone setting, a reverb effect setting, or an acoustic effect setting. The details of the types of phrases (sound emission data) that are set for every setting of the tone settings, reverb effect settings, and acoustic effect settings will be described later.

The RAM 12 is used as a working memory that temporarily stores various data necessary for the CPU 10 to execute a program. For example, operation processing data by the operation panel 1, key data taken from the keyboard 2, pedal position data taken from the pedal 14, etc., are temporarily stored in the RAM 12. The data stored in the RAM 12 is referred to by the CPU 10 via the system bus 30.

The key scan circuit 16 scans a state of the key switch of the keyboard 2, and outputs the same as key data indicating an ON/OFF state of the key. The key data is sent to the CPU 10 via the system bus 30, and temporarily stored in the RAM 12.

The key data stored in the RAM 12 is referred to at a predetermined timing.

The key data is, when it is in a state in which the operation button 1 has been pressed, used as data to perform tone selection, a sound setting, or the like based on a key number identifying a key where an event has occurred.

On the other hand, when it is in a state in which the operation button 1 has not been pressed, the key data is used for generating a key number identifying a key where an event has occurred and touch data indicating the strength (speed) of a key depression. The created key number and touch data are converted to frequency data and envelop data and sent to the sound source 18, and are used for a key depressing/key releasing processing or the like associated with key-on/key-off.

The sound source 18 is driven in accordance with musical sound data (a waveform address created corresponding to a tone number, frequency data created corresponding to a key number, envelop data created based on touch data and pedal position data, etc.) sent from the CPU 10 and a phrase (sound emission data) to be described later, and generates a digital musical sound signal by time division. The digital musical sound signal generated by the sound source 18 is output to the digital signal processing circuit 19.

A waveform memory 40 consists of, for example, a ROM, and has waveform data applied with pulse code modulation (PCM) stored therein. The waveform memory 40 has stored therein, in order to realize a plurality of tones, a plurality of types of waveform data (identified by tone number) corresponding to the respective tones. The waveform data stored in the waveform memory 40 is read out by the sound source 18.

The digital signal processing circuit 19 outputs a digital musical sound signal input from the sound source 18 and a coefficient input from the CPU 10 after performing a predetermined arithmetic processing therebetween. For example, a coefficient determined by a stepping amount of the damper pedal and the digital musical sound signal are subjected to an arithmetic processing to generate a digital musical sound signal imparted with a predetermined damper pedal effect. The digital musical sound signal generated by the digital signal processing circuit 19 is supplied to a D/A converter 20.

The D/A converter 20 converts the digital musical sound signal supplied from the sound source 18 to an analog musical sound signal. The analog musical sound signal output by the D/A converter 20 is sent out to an amplifier 21.

The amplifier 21 outputs the input analog musical sound signal after amplifying at a predetermined amplification factor. The analog musical sound signal subjected to predetermined amplification by the amplifier 21 is supplied to a speaker 22.

The speaker 22 converts an analog musical sound signal being an electrical signal to an acoustic signal. That is, by the speaker 22, a phrase (sound emission data) according to the type such as a tone setting, a reverb effect setting, or an acoustic effect setting is emitted, or a musical sound corresponding to a depression of each key of the keyboard 2 is emitted with an acoustic effect corresponding to a stepping amount of the pedal 14 imparted.

Figure 2:
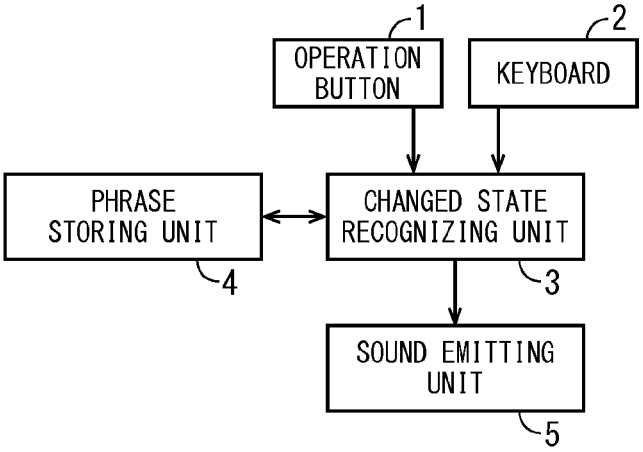
FIG. 2 is a functional block diagram showing a configuration of a sound preview device of the present invention.

FIG. 2 is a functional block diagram of a sound preview device built inside a digital piano (electronic musical instrument) by a sound preview program stored in the ROM 11 in the block diagram of FIG. 1.

A sound preview function is a function that, when tone selection or a sound setting is changed in a digital piano, automatically emits its sample sound as a phrase. This sound preview function is realized by including an operation button 1, a keyboard 2, a changed state recognizing unit 3, a phrase storing unit 4, and a sound emitting unit 5.

The operation button 1 and the keyboard 2 are used when changing tone selection or a sound setting. That is, as described above, by pressing the operation button 1 while pressing one of the keys in the keyboard 2, tone selection or a sound setting corresponding to the key is performed in advance.

The changed state recognizing unit 3 is for a processing to be executed in the CPU 10 by a sound preview program stored in the ROM 11, and recognizes from a pressed key a changed state of tone selection or a sound setting determined corresponding to the key in advance when a depression of the operation button 1 and a key (any key on the keyboard 2) is detected, and takes in sound emission data corresponding to the changed state from the phrase storing unit 4.

Figures 3, 4:
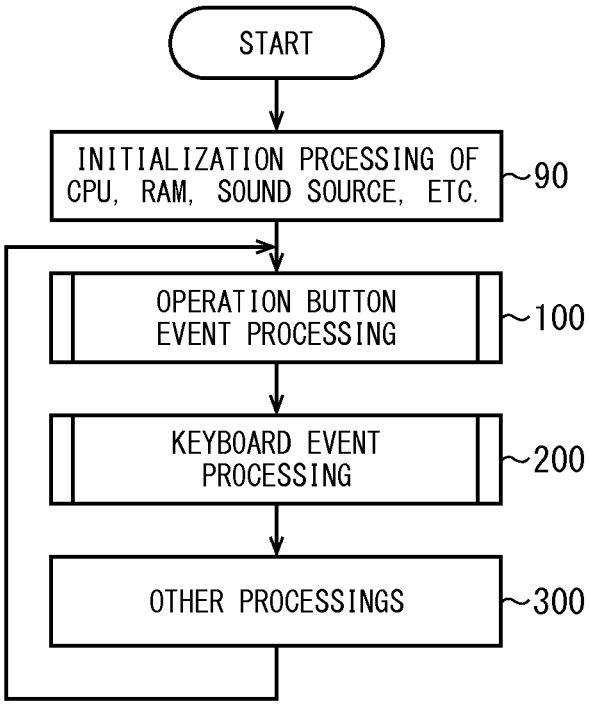
FIG. 3 is a table showing phrases of sample sounds corresponding to tone selection or sound settings.
FIG. 4 is a flowchart showing an overall processing procedure in the sound preview device.

The phrase storing unit 4 is provided inside the ROM 11 in the block diagram of FIG. 1, and has stored therein according to a changed state sample sounds of phrases of sounds by which the influence thereof is easily known in plural numbers. Examples of the phrases by sample sounds according to setting changes are shown in FIG. 3.

For example, as a phrase when a setting change is performed by respective keys (such as A0 to A1) corresponding to the tone selection 81, an Arpeggio consisting of C4, E4, G4, and C5 pitches (playing a chord of do, mi, sol, and do in order from the low-pitched tone) is stored as sound emission data. This is because, in the case of a tone, a sound emission of a chordal Arpeggio makes a difference easy to be recognized.

As a phrase when a setting change is performed by respective keys (B2 to A3) corresponding to the reverb settings 83 regarding a reverb effect, sound emission data by which only the C5 pitch (do) is emitted is stored. This is for making a difference in reverberations of "do" easy to be recognized by emitting a sole "do."

As a phrase when a setting change is performed by a key E4 corresponding to a damper resonance setting of the setting items 84, an Arpeggio consisting of C5, E5, G5, and C6 pitches (playing a chord of do, mi, sol, and do in order from the low-pitched tone) is stored as sound emission data. In addition, do, mi, sol, and do to be emitted in the case of the damper resonance setting is of an interval one octave higher than that of do, mi, sol, and do to be emitted in the case of the tone setting.

As a phrase when a setting change is performed by a key F4 corresponding to a damper noise setting of the setting items 84, sound emission data by which only the C5 pitch (do) is emitted is stored.

As a phrase when a setting change is performed by a key G4 corresponding to a string resonance setting of the setting items 84, an Arpeggio consisting of G4, A4, B4, and C5 pitches (playing a chord of sol, la, ti, and do in order from the low-pitched tone) to be emitted with a key C4 (do) pressed is stored as sound emission data. This is for catching a resonance with respect to the key C4 (do).

As a phrase when a setting change is performed by a key B4 corresponding to a key action noise setting of the setting items 84, sound emission data by which only the C4 pitch (do) is emitted is stored.

The sound emitting unit 5 corresponds to the sound source 18, the digital signal processing circuit 19, the D/A converter 20, the amplifier 21, and the speaker 22 in the block diagram of FIG. 1, and emits a phrase of sound emission data corresponding to a changed state taken from the phrase storing unit 4 by the changed state recognizing unit 3.

Figure 5:
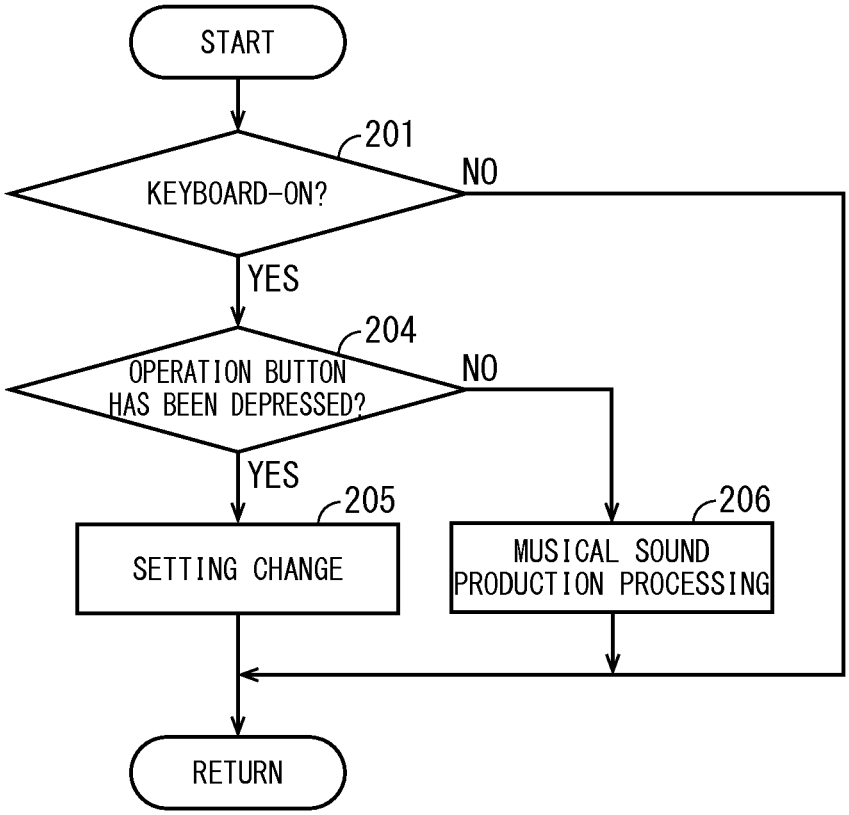
FIG. 5 is a flowchart showing a procedure of a keyboard event processing in the sound preview device.

Next, the operation of the digital piano described above will be described in detail with reference to the flowcharts shown in FIG. 4 and FIG. 5, mainly on the sound preview function.

FIG. 4 is a main flowchart showing various processings in a digital piano, and the processing is started by power-on. That is, when the digital piano is powered on, first, an initialization processing of the CPU 10, the RAM 12, the sound source 18, etc., is performed (step 90).

In the initialization processing, a clearing processing of registers and flags in an interior of the CPU 10, an initial value setting processing for various buffers, registers and flags, etc., defined inside the RAM 12, a process of setting an initial value for the sound source 18 to prevent an unnecessary sound from being emitted, etc., are performed.

Next, an operation button event processing is performed (step 100).

In the operation button event processing, a start of implementing the sound preview function is selected by a depressing operation of the operation button 1. That is, a start of implementing the sound preview function is selected by detecting whether there is a depression (switching-on) of the operation bottom 1.

Next, a keyboard event processing is performed (step 200).

In the keyboard event processing, operations regarding the keyboard 2, that is, a processing corresponding to a setting operation such as tone selection or a sound setting and a sound emitting operation by a depression of each key on the keyboard are performed. A processing procedure of the keyboard event processing is shown in FIG. 5.

In the keyboard event processing, first, whether there is a keyboard-on event is detected (step 201). For detecting whether there is a keyboard-on event, key data indicating ON/OFF states of the respective keys are obtained by scanning the keyboard 2 via the key scan circuit 16, and bit sequences corresponding to the respective keys are read in as new key data.

Subsequently, old key data read in last time in the same manner and already stored in the RAM 12 is compared with the above-mentioned new key data to detect whether different bits exist. Then, if different bits exist, it is recognized that a key event has occurred, and an event map is created in which a bit corresponding to a key with a change is set to be ON.

Moreover, a judgement as to whether there is a key event is performed by examining the key event map. That is, if a bit that is ON does not exist in the key event map, it is recognized that no key event has occurred, and the processing returns to the main routine by returning from the keyboard event processing routine.

On the other hand, if a bit that is ON exists in the key event map, it is recognized that a key event has occurred, and subsequently, whether being an on-event of a key is judged. This is performed by detecting whether being on about a bit in the above-mentioned new key data corresponding to the above-mentioned bit that is ON in the key event map.

Next, whether the operation button 1 has been depressed is detected with keyboard-on (step 204), and if the operation button 1 has been depressed, a processing of a setting change regarding tone selection or a sound setting is performed (step 205).

In the processing of a setting change regarding tone selection or a sound setting, a sample sound of a phrase stored in advance in the phrase storing unit 4 is emitted. Also, because the phrase is provided, as described above, according to a changed state of the setting change, as a sound emission of a chordal Arpeggio or pitches by which the influence of the changed state is easily known, the changed state can be easily aurally confirmed.

Figure 6:
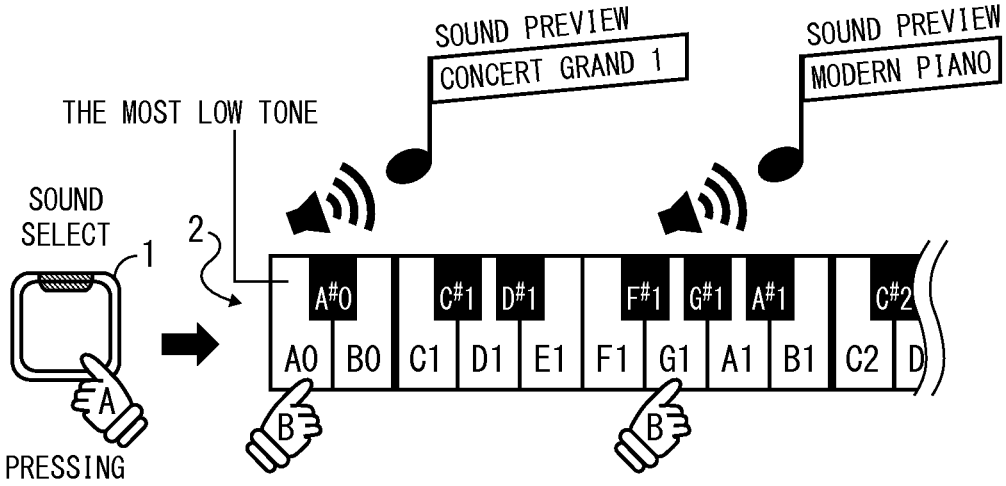
FIG. 6 is a model view for describing a sound preview function.

Specifically, as shown in FIG. 6, when the operation button (sound select key) 1 is pressed by a finger (operation A) while depressing a key A0 of the keyboard 2 by a finger (operation B), because the key A0 corresponds to a piano sound of a "concert grand 1" in the tone selection, the "concert grand 1" is set as a tone, and an Arpeggio consisting of C4, E4, G4, and C5 pitches (playing a chord of do, mi, sol, and do in order from the low-pitched tone) by the piano sound of the "concert grand 1" is emitted as a sound preview.

Also, when the operation button (sound select key) 1 is pressed by a finger (operation A) while depressing a key G1 of the keyboard 2 by a finger (operation B), because the key G1 corresponds to a piano sound of a "modern piano" in the tone selection, the "modern piano" is set as a tone, and an Arpeggio consisting of C4, E4, G4, and C5 pitches (playing a chord of do, mi, sol, and do in order from the low-pitched tone) by the piano sound of the "modern piano" is emitted as a sound preview.

Also, in step 204, if the operation button 1 has not been depressed, a musical sound production processing based on a performance action of musical sound data created by the key position in the keyboard 2 and the strength of a depression is performed (step 206).

In addition, when the keyboard event processing ends, "other processings" are subsequently performed (step 300). In the "other processings," for example, a transmission/reception processing etc., of MIDI data is performed via the MIDI interface circuit 15. Thereafter, the processing returns to the operation button event processing in step 100, and in the following, the same processings are repeated.

By the sound preview device described above, because a phrase of a sample sound is emitted when tone selection or a sound setting is changed, a change in sound due to the setting change can be easily aurally confirmed instantaneously.

Also, because a phrase (chordal Arpeggio or pitches) corresponding to the content of a setting (changed state) stored in advance in the phrase storing unit 4 is emitted, a difference of a change in settings can be more easily recognized than by a player's own play.

Also in an electronic musical instrument of a type without an operation panel to display the contents of settings, having performed a change can be reliably recognized concerning a change in tone selection or sound settings.

The invention claimed is:

1. A sound preview device in an electronic musical instrument which includes a keyboard and an operation button to perform tone selection or a sound setting and in which tone selection or a sound setting corresponding to a key is performed in advance by pressing the operation button while pressing one of the keys in the keyboard, comprising:

a changed state recognizing unit that recognizes from a pressed key a changed state of tone selection or a sound setting determined corresponding to the key in advance;

a phrase storing unit in which phrases of sounds by which an influence of the changed state is known are stored in plural numbers according to the changed state; and a sound emitting unit that emits a phrase corresponding to the changed state.

2. The sound preview device according to claim 1, wherein when a tone or sound setting is changed by the key, a sound phrase is emitted.

3. The sound preview device according to claim 1, wherein when a tone is changed by the key, a phrase of an Arpeggio consisting of C4, E4, G4, and C5 pitches is emitted.

4. The sound preview device according to claim 1, wherein when a reverb setting is provided by the key, only a C5 pitch is emitted.

5. The sound preview device according to claim 1, wherein when a damper resonance setting is provided by the key, a phrase of an Arpeggio consisting of C5, E5, G5, and C6 pitches is emitted.

6. The sound preview device according to claim 1, wherein when a damper noise setting is provided by the key, only a C5 pitch is emitted.

7. The sound preview device according to claim 1, wherein when a string resonance setting is provided by the key, a phrase of an Arpeggio consisting of G4, A4, B4, and C5 pitches is emitted with a C4 key pressed.

8. The sound preview device according to claim 1, wherein when a key action noise setting is provided by the key, only a C4 pitch is emitted.

9. A non-transitory computer readable medium for storing a sound preview program in an electronic musical instrument which includes a keyboard and an operation button, the program when executed by a computer performing a process comprising:

performing a tone selection or a sound setting corresponding to a key by pressing the operation button while pressing one of the keys in the keyboard;

detecting, from a pressed key, a changed state of tone selection or a sound setting determined corresponding to the key;

storing phrases of sounds by which an influence of the changed state is known in plural numbers according to the changed state, in a storage device; and emitting a phrase corresponding to the changed state as a sample sound.

* * * * *